United States Patent [19]

Carino

[11] 4,352,438

[45] Oct. 5, 1982

[54] PROTECTIVE SHIELD FOR OPEN CONTAINER

[76] Inventor: Charles M. Carino, 264 S. Fourth Ave., Ilion, N.Y. 13357

[21] Appl. No.: 233,831

[22] Filed: Feb. 12, 1981

[51] Int. Cl.[3] ..... B65D 90/52

[52] U.S. Cl. ..... 220/90; 220/90.4; 220/90.6; 220/449; 229/3.5 MF

[58] Field of Search ..... 220/90, 90.2, 90.4, 220/90.6, 449, 354; 229/3.5 MF; 150/52 R

[56] References Cited

U.S. PATENT DOCUMENTS

| | | | |
|---|---|---|---|
| 2,268,241 | 12/1941 | Brueckel | 220/90 |
| 2,668,635 | 2/1954 | Bennett | 220/90 |
| 2,753,049 | 7/1956 | Gaines et al. | 220/90.6 |
| 2,945,611 | 7/1960 | Weiffenbach | 220/90 |
| 2,945,612 | 7/1960 | Weiffenbach | 220/90 |

FOREIGN PATENT DOCUMENTS

| | | | |
|---|---|---|---|
| 252844 | 4/1927 | Italy | 220/90.6 |

*Primary Examiner*—William Price
*Assistant Examiner*—Gary E. Elkins
*Attorney, Agent, or Firm*—Bruns & Jenney

[57] ABSTRACT

A protective device for temporarily shielding the upper surfaces of an open liquid container, such as a paint can or the like, to prevent the contained liquid from accumulating upon the upper surfaces thereof. The device involves an endless loop made of a deformable metal foil that is passed partially over the top of the container so that the top section of the loop extends upwardly above the upper rim of the container. The top section is folded inwardly over the rim of the container and is pressed tightly thereagainst to form a tight seal. The outer portion of the folded section is then passed downwardly into the container opening to form a circular wall depending from the lip of the rim which serves to prevent contained liquid from spilling over the lip of the rim.

7 Claims, 5 Drawing Figures

PROTECTIVE SHIELD FOR OPEN CONTAINER

BACKGROUND OF THE INVENTION

This invention relates to a protective device for temporarily shielding the upper surfaces of an open liquid container to prevent the contained liquid from spilling over the rim of the container and accumulating upon the protected surfaces.

Cans or containers that are used to store paints, glues, stains, varnishes and other similar types of air drying liquids come in a range of sizes. However, most involve the same basic structure. Conventionally, the can is an upright cylinder having a flat cover or lid that is used to seal an opening formed in the top of the cylinder. A rim having a recessed annular groove surrounds the opening. The recess is adapted to receive a complimentary ridge formed in the cover to provide an effective air and liquid tight seal therebetween. When the cover is removed from the can, the recessed groove is exposed. Subsequent use of the contents usually results in the liquid accumulating in the groove and/or flowing down the side wall of the can. As is well known, the accumulated liquid in the sealing groove quickly dries and thus prevents proper closure of the cover whereupon the stored material deteriorates to a point where it can no longer be used. Similarly, paint, or the like, flowing over the side wall of the can will obscure labels hiding the identity of the ingredients and covering other important information relating to the care and use of the contents. Finally, liquid that has accumulated in the groove is generally splattered over adjacent surfaces when the lid is hammered closed.

Protective devices for paint cans and the like have been known and used for quite some time as evidenced by the disclosures in U.S. Pat. Nos. 4,014,465; 3,972,453 and 2,873,881. Predominantly, these prior art devices are rather rigid attachments formed of sheet metal or the like which are press-fitted over the top of the can to more or less form a semipermanent extension thereof. Installing and removing the device can in itself be a rather hazardous operation. Oftentimes, because of the complexity of the procedures involved, the can is tipped and the contents spilled. Furthermore, because these protective devices are intended to be used over and over again, they themselves eventually become contaminated with paints, varnishes and the like. When this occurs, the device can no longer be fitted properly to the can and thus fails to deliver the intended protection.

In U.S. Pat. Nos. 2,945,611 and '612 protective paint can shields are described that are made from die cut paper blanks. The geometry of the blank is relatively complex and therefore relatively expensive to cut. To assemble the shield, the blank must be folded several times and shield tabs, which are intended to surround the body of the can, joined together using cooperating notches or slits cut into the ends of the tabs. This type of shield is not only difficult to install but generally results in the formation of a relatively loose assembly. Accordingly, the shield can be easily dislodged from the can and, in some cases, the contents of the can will be able to flow beneath the shield and contaminate the surfaces that are intended to be protected. Paper is also a highly absorbtive material, particularly in relation to many of the oil based liquids typically stored in this type of container. The oil based liquids therefore can, under certain conditions, rapidly soak through the shield to reach the underlying surfaces.

SUMMARY OF THE INVENTION

It is therefore an object of the present invention to improve devices used for protecting the normally exposed surfaces of a liquid container, such as paint cans and the like.

Another object of the present invention is to provide a protective shield for a paint type can that provides a positive seal about the can opening that cannot be penetrated by the liquid contained therein.

Yet another object of the present invention is to provide an inexpensive shield for a paint can that can be disposed of after use.

A further object of the present invention is to provide a protective shield for a paint can or any other similar type container that can be quickly and safely installed and removed therefrom.

A still further object of the present invention is to provide a protective shield for a paint type can that is virtually impossible to inadvertently dislodge from the can once it is set in place.

While a still further object of the present invention is to provide a protective shield for a paint type can that will not absorb liquids.

These and other objects of the present invention are attained by means of a shield for protecting the generally exposed upper surfaces of an open liquid container, such as a paint can, to prevent the liquid contained therein from spilling or accumulating upon the surfaces and the top rim of the can. The shield involves an endless loop of thin metal foil that can be easily pressed into conforming contact against the container surfaces. The lower section of the loop is passed over the upper sidewall of the can and the middle section of the loop is then folded over the rim. The foil is pressed securely against the rim to form a seal and the upper section of the loop is folded downwardly into the can opening to form an annular wall depending from the lip of the rim which serves to prevent contained liquid from passing over the lip.

BRIEF DESCRIPTION OF THE DRAWINGS

For a better understanding of these and other objects of the present invention, reference is had to the following detailed description of the invention which is to be read in conjunction with the accompanying drawings, wherein.

DESCRIPTION OF THE INVENTION

Figure 1:
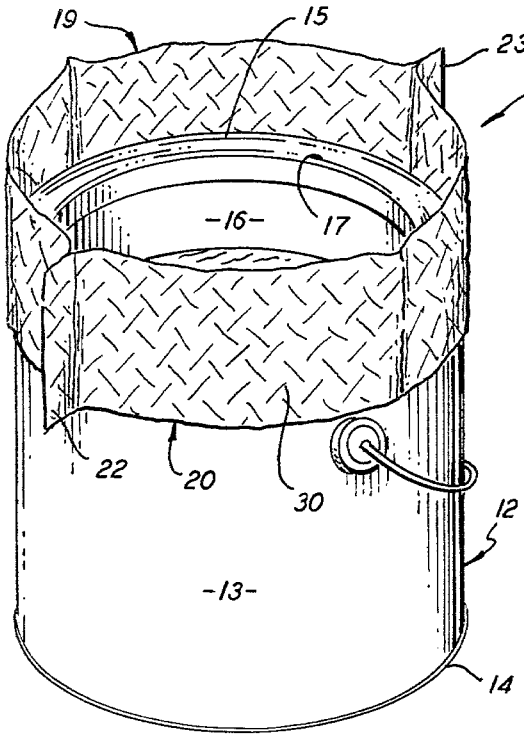
FIG. 1 is a perspective view of an open paint can having a protective foil shield embodying the present invention positioned over the top margin of the can in an initial mounting position.
Figure 2:
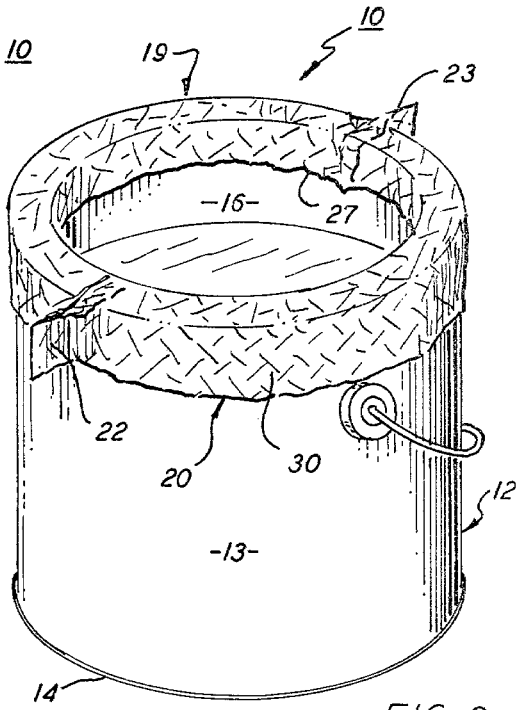
FIG. 2 is also a perspective view of the can shown in FIG. 1 illustrating the shield folded inwardly into a sealing position against the upper rim of the can.
Figure 3:
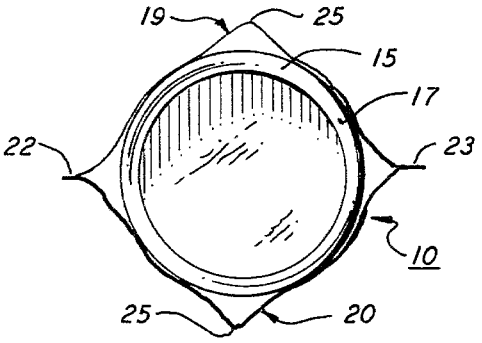
FIG. 3 is a top view in reduced size showing the shape of the shield in relation to the can when the shield is in the initial mounting position prior to folding.

Referring initially to FIGS. 1–3, there is shown a protective shield embodying the teachings of the present invention that is generally referenced 10. The shield will be explained in conjunction with an open paint can 12. However, it should be evident from the present disclosure that the shield can be used in association with any similar type can or container that is used to store fast drying liquids or the like. Typically, a can of this nature involves an upright cylindrical body 13 that is closed at the lower end by a bottom wall 14 which also serves as a flat stable base for the container. The upper section of the can contains a rim flange 15 that surrounds the can opening 16. A recessed annular groove 17 is formed in the rim flange to receive the can cover or lid therein. Although not shown, the conventional cover contains a depending ring portion that is adapted to pass into the recessed groove and frictionally engage the walls thereof closing the cover and providing an airtight seal. As can be seen, when the cover is removed, the cover receiving groove and adjacent surfaces can be soiled with an accumulation of the contained liquid as it is being poured or brushed from the container. Similarly, the contained liquid can also spill over the rim of an open can when the contents are being mixed or the can is moved from place to place.

As best seen in FIG. 3, the protective shield 10 involves an endless loop that is formed by joining together two flat sheets of metal foil 19 and 20. Preferably the sheets are fabricated from thin strips of aluminum foil that are cut to equal lengths and widths. In assembly, the two sheets of foil are placed in a face to face relationship and the contacting ends thereof are secured together to both close the loop and to establish a pair of outwardly extended end tabs 22 and 23 that are used to expand the loop from its flat storage position to an open position where it can be slipped over the top of the container. Any suitable means for establishing a reasonably good bond between the sheets may be used to close the loop.

A vertical fold or score line 25, that is located midway between the end tabs, is formed in each sheet. The sheets are folded back against each other along the fold lines for purposes of packaging and storing. This, in turn, will place the tabs at about the midregion of the flattened structure. To position the shield over an open container, the tabs are simply grasped and pulled apart thereby opening the loop about the fold lines. The open loop assumes a generally square shape as shown in FIG. 3 which can be easily slipped over the top of a suitable container. Upon releasing the tabs, the walls of the loop spring back toward the original flat storage position and lightly embrace the encircled body of the container to support the loop against the cylindrical body of the can so that further working of the loop may proceed.

In practice, only the lower section of the loop is passed over the top of the open container to position the shield in what is herein referred to as an initial mounting position as shown in FIG. 1. The middle and upper sections of the loop, which extend over the top of the can, are folded inwardly over the top rim. The readily workable foil is pressed tightly against the rim to form a tight seal thereagainst. In some cases, it may be preferred to press the foil tightly into the receiving groove formed in the rim to establish a conforming seal about the groove. The upper section of the loop, which is now overlying the can opening, is folded downwardly into the opening to form a protective circular wall 27. The wall is pressed tightly against the lip of the rim to provide a seal therebetween. In assembly, the circular wall depends downwardly some distance into the can to establish an open bottomed annular chamber about the inner surface of the rim. The protective wall serves as a splash barrier which prevents contained liquids from spilling over the rim when the contained liquid is being mixed or stirred, or in the event the container is tipped slightly as oftentimes occurs when it is being moved from place to place. Similarly, the container may even be laid upon its side without danger of spillage when the liquid level therein is relatively low.

The outer surface of the foil is provided with a textured surface containing a plurality of embossed lines that are able to intercept a flow of liquid that might be passing over the vertical skirt portion 30 of the shield overlying the side wall of the container. In the embodiment of the invention shown in FIGS. 1 and 2, the embossed lines are turned obliquely in reference to the vertical center line of the loop. Accordingly, any liquid moving under the influence of gravity down the protected side wall of the container is caused to move over a tortuous path of travel which greatly increases the contact time between the liquid and the shield. In the case of most air drying liquids, such as paint, the liquid will become semi-dry during this period and thus tend to adhere to the shield rather than run down the exposed side of the container.

Figure 4:
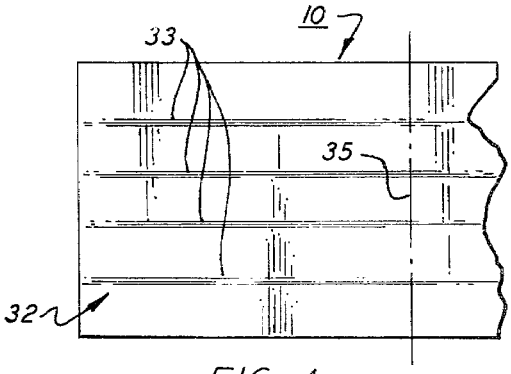
FIG. 4 is an enlarged partial side view of a foil shield embodying the teachings of the present invention wherein the shield contains a plurality of horizontally extended embossments.

FIG. 4 shows another embodiment of the invention wherein the body 32 of the shield 10 is provided with a series of equally spaced outwardly embossed rings 33—33. The rings are positioned generally normal to the axis 35 of the shield and, in assembly, act as dams or barriers to the contained liquid. As can be seen, any liquid moving down the skirt portion of the shield will be held back by the barriers. In the event the liquid spills over one barrier, it will encounter the next barrier and so on down the line making it extremely difficult for the liquid to circumvent the shield boundaries.

Figure 5:
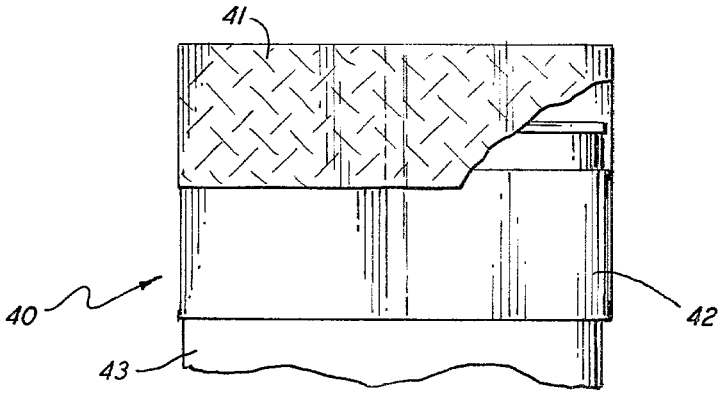
FIG. 5 is a side view showing another form of a shield embodying the teachings of the present invention positioned over the top of a paint can.

Turning now to FIG. 5, there is shown still another embodiment of the invention. The shield 40 is herein formed in two sections that include an upper section 41 made of a textured metal foil as described above and a lower section 42 made of a material that is capable of absorbing the liquid contained within the can. The absorptive lower section of the shield, in assembly, forms part of the shield skirt that is positioned over the side wall of the can 43. The shield is mounted upon the container as described above and the upper foil section is sealed against the rim as shown in FIG. 2 to establish a protective barrier about the can opening. In the event some of the liquid is caused to flow down the side of the container, it will eventually come in contact with the absorptive portion of the skirt where it will be absorbed thus preventing it from coming in contact with the lower exposed part of the container. In light of the fact that the present shield is to be used only once and then discarded, contaminating of the skirt with absorbed liquid generally poses no great problem. In practice, the absorptive part of the skirt can be made of paper strips that are glued or otherwise bonded to the upper foil section.

As can be seen, the present shield is relatively inexpensive and easy to manufacture and can thus be economically disposed of after it has been used. Furthermore, the shield can be made to conform to the contour of any shaped container to protect the normally exposed surfaces thereof from collecting the contained liquid. When in place, the present shield will also help to prevent spill from occurring when the liquid is stirred or the open can is moved from place to place.

Although the present invention has been explained in reference to a container having a lid-sealing grout formed in the upper rim thereof, it should be evident that the present device can be used with equal effectiveness in association with similar type containers which do not require a receiving groove to seal the lid.

While this invention has been described with reference to the details as set forth above, it is not limited to the specific structure as disclosed and the invention is intended to cover any modifications or changes as may come within the scope of the following claims.

I claim:

1. A protective device for use in conjunction with a liquid container of the type having an annular cover receiving rim that surrounds an opening formed in the top of the container, said protective device including an endless loop made of a thin deformable metal foil having a peripheral length that is slightly greater than the outer periphery of the container body, the lower portion of the foil loop passing coaxially over the top of the container to encircle its body, the middle portion of the foil loop being folded inwardly over the rim of the container to form a contoured surface that is seated in conformity against the rim and the top portion of the foil loop being folded downwardly into the container opening to form an annular protective wall about the opening and said foil loop containing a textured outer surface having a plurality of embossed lines that are obliquely inclined in reference to the center axis of said loop whereby liquid moving over said surface under the influence of gravity will remain in contact with said surface for an extended period of time.

2. The protective device of claim 1 wherein said foil loop contains a series of spaced-apart circular ribs extending outwardly from the outside surface thereof, said ribs being substantially normal to the axis of said loop.

3. The protective device of claim 1 that further includes at least one radially extended tab secured to the outer wall of the loop to facilitate mounting and removal of the loop from the container.

4. The protective device of claim 1 wherein the lower portion of said loop further includes a circular skirt that is formed of a liquid-absorbing material.

5. The protective device of claim 4 wherein the skirt is formed of paper that is bonded to the metal foil.

6. A protective shield for a liquid container of the type having a generally cylindrical body and an upper rim surrounding the container opening, said rim having a recessed cover receiving groove formed therein, said shield being produced by the process of forming a loop of thin metal foil by joining the ends of two equal sized bands of foil, the outside surface of said bands being textured, passing the lower section of the loop over the top of an open container, folding the middle section of the loop over the rim of the container, pressing the middle section of the loop into conforming contact against the surface of the recessed groove formed in the firm of the container to create a tight seal thereagainst, passing the upper section of the loop downwardly through the container opening to form a downwardly extending circular wall depending from the lip of the rim, and pressing the circular wall against the lip to create a seal thereagainst.

7. The protective shield of claim 6 that further includes providing a skirt about the lower section of said loop that is formed of an absorptive material.

* * * * *